US006073757A

United States Patent [19]

Kornick et al.

[11] Patent Number: 6,073,757

[45] Date of Patent: Jun. 13, 2000

[54] COMBINED BOTTLE AND LENS CASE

[75] Inventors: Joseph M. Kornick; J. Tirso Olivares, both of Chicago, Ill.

[73] Assignee: Allergan, Irvine, Calif.

[21] Appl. No.: 09/088,929

[22] Filed: Jun. 2, 1998

[51] Int. Cl.[7] ..... A45C 11/04

[52] U.S. Cl. ..... 206/5.1; 206/223; 206/501; 220/23.83; 220/729

[58] Field of Search ..... 206/5.1, 501, 229, 206/821, 509, 223; 220/23.86, 729, 735, 23.6, 23.83; 215/390, 10

[56] References Cited

U.S. PATENT DOCUMENTS

| | | | |
|---|---|---|---|
| 2,274,973 | 3/1942 | Bryant . | |
| 2,374,092 | 4/1945 | Glaser | 215/10 |
| 2,744,649 | 5/1956 | Smith . | |
| 2,940,589 | 6/1960 | Silverman | 206/5.1 |
| 2,949,203 | 8/1960 | Berg . | |
| 3,089,500 | 5/1963 | Stalcup . | |
| 3,124,240 | 3/1964 | Groan . | |
| 3,326,358 | 6/1967 | Singleton . | |
| 3,339,047 | 8/1967 | Otis et al. . | |
| 3,804,233 | 4/1974 | Gregg . | |
| 3,966,076 | 6/1976 | Kroger . | |
| 4,195,728 | 4/1980 | Cardamone . | |
| 4,235,343 | 11/1980 | Thompson | 215/6 |
| 4,429,786 | 2/1984 | Hucal | 206/5.1 |
| 4,563,186 | 1/1986 | Flynn et al. . | |
| 4,640,423 | 2/1987 | Mednis . | |
| 4,776,972 | 10/1988 | Barrett . | |
| 4,856,647 | 8/1989 | Dahne . | |
| 4,951,811 | 8/1990 | Lines . | |
| 4,966,296 | 10/1990 | Farrell . | |
| 5,050,757 | 9/1991 | Hidding et al. . | |
| 5,065,875 | 11/1991 | Balavich . | |
| 5,174,534 | 12/1992 | Mitchell . | |
| 5,211,299 | 5/1993 | Manfredonia | 215/11.1 |
| 5,415,275 | 5/1995 | Girimont | 206/5.1 |
| 5,647,481 | 7/1997 | Hundertmark et al | 206/219 |

*Primary Examiner*—Paul T. Sewell
*Assistant Examiner*—Nhan T. Lam
*Attorney, Agent, or Firm*—Walter A. Hackler

[57] ABSTRACT

A container arrangement for contact lenses and solution therefor includes a lens case having receptacles for storing contact lenses in contact lens solution. A bottle is provided for containing the contact lens solution. A bottle is provided for containing the contact lens solution and a cavity integrally formed into a bottom of the bottle is provided for receiving and holding the contact lens case within confines of a bottle bottom perimeter and in an orientation providing upright level storage of the contact lenses.

14 Claims, 2 Drawing Sheets

COMBINED BOTTLE AND LENS CASE

The present invention generally relates to the storage and use of contact lenses and is more particularly directed to a combined contact lens solution bottle and lens case.

Contact lenses, for example, soft contact lenses, are hydrophilic and generally contain from about 20 percent to about 90 percent water, by weight. This suggests, when not in use, the need for proper storage containers as well as the means to maintain the lenses in a sterile aqueous solution within a water-tight package. A great number of such storage containers have been designed which preferably store the contact lenses in a level position in order to ensure submersion of the contact lens in an appropriate contact lens solution and to prevent any leakage of the solution through caps covering the contact lenses while they are held in separate receptacles.

It is also well known that an application of a suitable wetting agent to contact lenses after removal from temporary storage is helpful for the user. In addition, it may be desirable for the user to employ a small quantity of a liquid prescription to alleviate any minor eye irritations which may occur.

Consequently, it is necessary for most contact lens users to employ, in conjunction with a lens case, a separate bottle for the dispensing of an appropriate contact lens solution to the lens in connection with the use thereof.

Since a lens solution bottle and lens case combination would have advantage, a number of devices heretofore have been developed to incorporate this combination. For example, U.S. Pat. No. 3,326,356 is directed to a container for contact lenses which is readily attachable to a lens cleaning fluid container. Unfortunately, this device provides for a combination requiring the lens case to be inverted upon storage. Thus, if the lens caps are not securely in place, inadvertent leakage of fluid may occur. As a result, without water-tight storage, there is a possibility that the lenses are not sufficiently wet to maintain their required high-water content.

Thus, it is desirable to provide for a combined bottle and lens case in which level storage of the contact lens is ensured without the absolute necessity of a water-tight seal between caps secured to a receptacle or housing for containing the lenses.

In addition, it is preferable that the combination be stable when disposed on the shelf, counter or the like, so that inadvertent jarring thereof will not cause a tipping of the bottle which may result in advertent spilling of lens contact solution.

The present invention provides for a container arrangement overcoming the deficiencies of the prior art.

SUMMARY OF THE INVENTION

A container arrangement for contact lenses and solution in accordance with the present invention generally includes a contact lens case having receptacles means for storing contact lenses in contact lens solution along with a cap which provides means for sealing the receptacle means.

A bottle provides means for containing a contact lens solution and cavity means, integrally formed into a bottom of the bottle, is provided for receiving and holding the contact lens case within the confines of the bottle bottom perimeter. This configuration enables a stable base for the bottle which inhibits tipping thereof.

In addition, the cavity means provides for holding the contact lens case in an orientation providing upright level storage of the contact lenses. This feature ensures that the contact lenses within the receptacles will remain submerged in solution and, further, the upright storage prevents any leakage of the solution past the cap means should the latter not be properly secured to the receptacle means.

More particularly, the contact lens case in accordance with the present invention may include an elongate molded base having right and left receptacles disposing the side-by-side relationship. In this embodiment the cavity means includes a slot extending transverse to a bottle means longitudinal access. Preferably, the slot includes a lip disposed flush with the bottom surface of the bottle means which, in turn, provides a means for preventing downward separation of the contact lens case from the bottle means.

Transverse sliding of the base within the slot is inhibited by a combination of structural elements which include an arcuate shape of the base and a base material for providing flexure thereof. That is, the base flexure, enables a minute flattening of the arcuate shape of the base within the slot which in turn prevents inadvertent movement therein and ensures stability of the contact lens case within the bottle slot. Preferably, the slot is disposed along a diameter of the bottle bottom and extends across the bottle bottom from one side to another in order to provide access to the contact lens case from one or another side of the bottle means. As hereinabove noted, bottle stability is effected in the present invention by providing a slot which has an open area on the bottom bottle smaller than the closed bottle bottom area.

BRIEF DESCRIPTION OF THE DRAWINGS

The present invention can be more easily understood by consideration of the following detailed description, particularly in conjunction with the accompanying drawings, in which.

DETAILED DESCRIPTION

Figure 1:
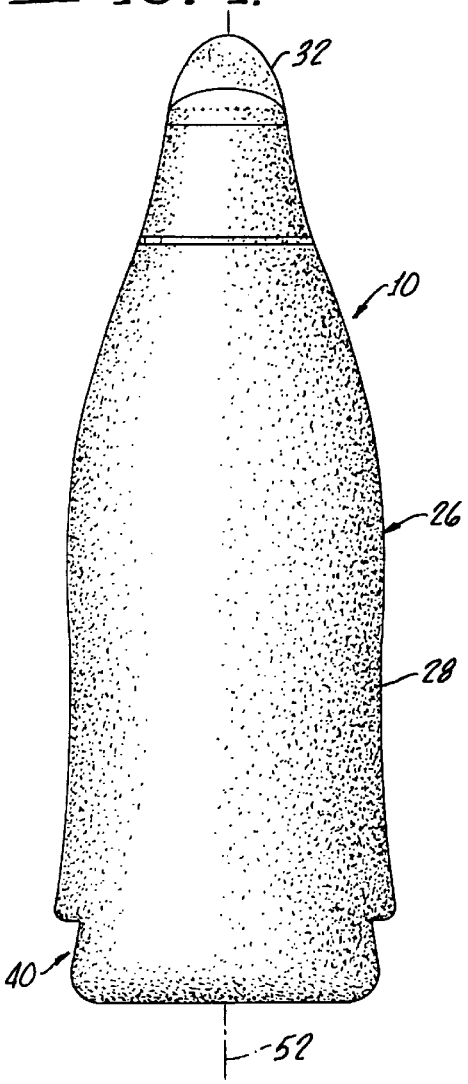
FIG. 1, is a side elevational view of a container arrangement in accordance with the present invention in which a contact lens case is received with a cavity formed into a bottom of a bottle and showing the contact lens case being within confines of a bottle bottom perimeter.

Turning now to FIGS. 1–5, there is shown a container arrangement 10 in accordance with the present invention which generally includes a contact lens case 12 having right and left receptacles 14, 16 which provide a means for receiving a pair of contact lenses (not shown), and a contact lens solution (not shown).

Caps 20, 22 (see FIG. 5) threadably engage the receptacles 14, 16, respectively, and provide a means for sealing the receptacles 14, 16.

A squeezable bottle 26 is provided as a means for containing a contact lens solution (not shown) and may be formed from any suitable material for containing the contacts and lens solution. Preferably, the bottle 26 includes a squeezable sidewall 28 for enabling dispensing of the contact lens solution through a tip 30 when a cap 32 is removed. The tip 30 may be attached to the bottle 26 by way of a top 36 in any conventional matter. Alternatively, the tip 30 and top 36 may be integrally formed as part of the bottle 26.

Figure 2:
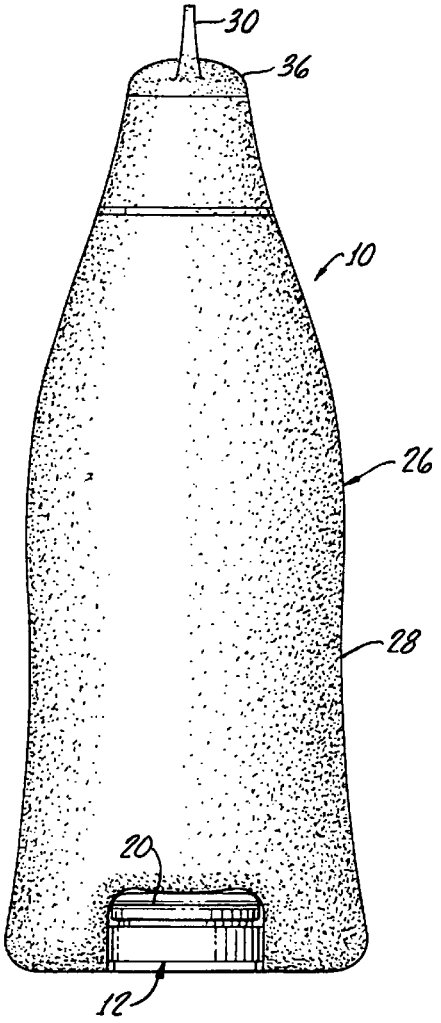
FIG. 2, is a side elevational view of the container arrangement shown in FIG. 1 showing an end view of the contact lens case as it is disposed in the bottle cavity.
Figure 3:
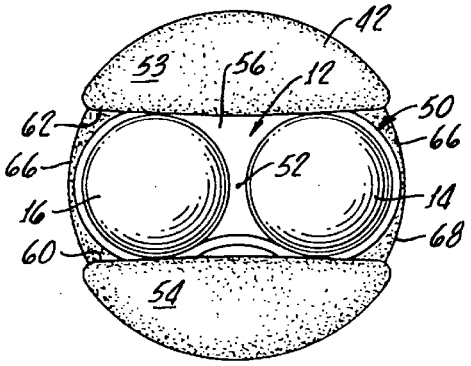
FIG. 3, is a bottom view of the bottle showing the lens case being disposed within the confines of the bottle bottom.
Figure 4:
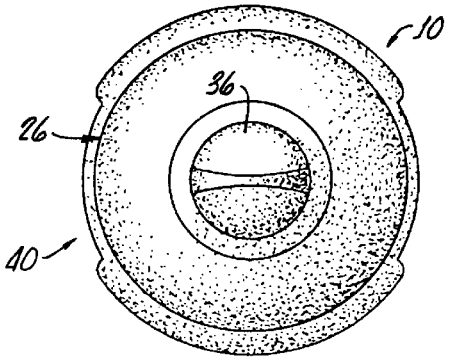
FIG. 4, is a top elevational view of the container arrangement.

Importantly, a cavity 40 (See FIG. 1) integrally formed into a bottom 42 of the bottle 26 provides a means for receiving and holding the contact lens case 12 within confines of a bottle bottom perimeter 46 (see FIG. 3, and in an orientation as shown in FIG. 2 which provides for upright level storage of the contact lense case 12 with contact lenses (not shown) therein. Because the contact lens case 12 is contained within the bottle bottom perimeter 46, stability of the bottle itself is maintained. That is, the bottle bottom 46 has sufficient area to stably support the bottle 26 in an upright position.

More particularly, the cavity 40 comprises a slot 50 which extends transverse to a bottle longitudinal axis 52. Turning specifically to FIG. 3, it is shown that stability of the bottle 26 may be further effected by providing that the slot 50 defines an open surface area on the bottle bottom 42 that is smaller than a closed surface area, defined by portions 53, 54, of the bottle bottom 42. In other words, the bottom 42 of the bottle 26 may have a closed surface area 53, 54 greater than an open surface area defined by the slot 50.

The lens case 12 includes an elongate molded base 56 having the receptacles 14, 16 disposed in a side-by-side relationship.

In order to prevent downward separation of the contact lens case 12 from the bottle bottom 42, a pair of lips 60, 62, formed as part of the slot 50, are provided.

Figure 5:
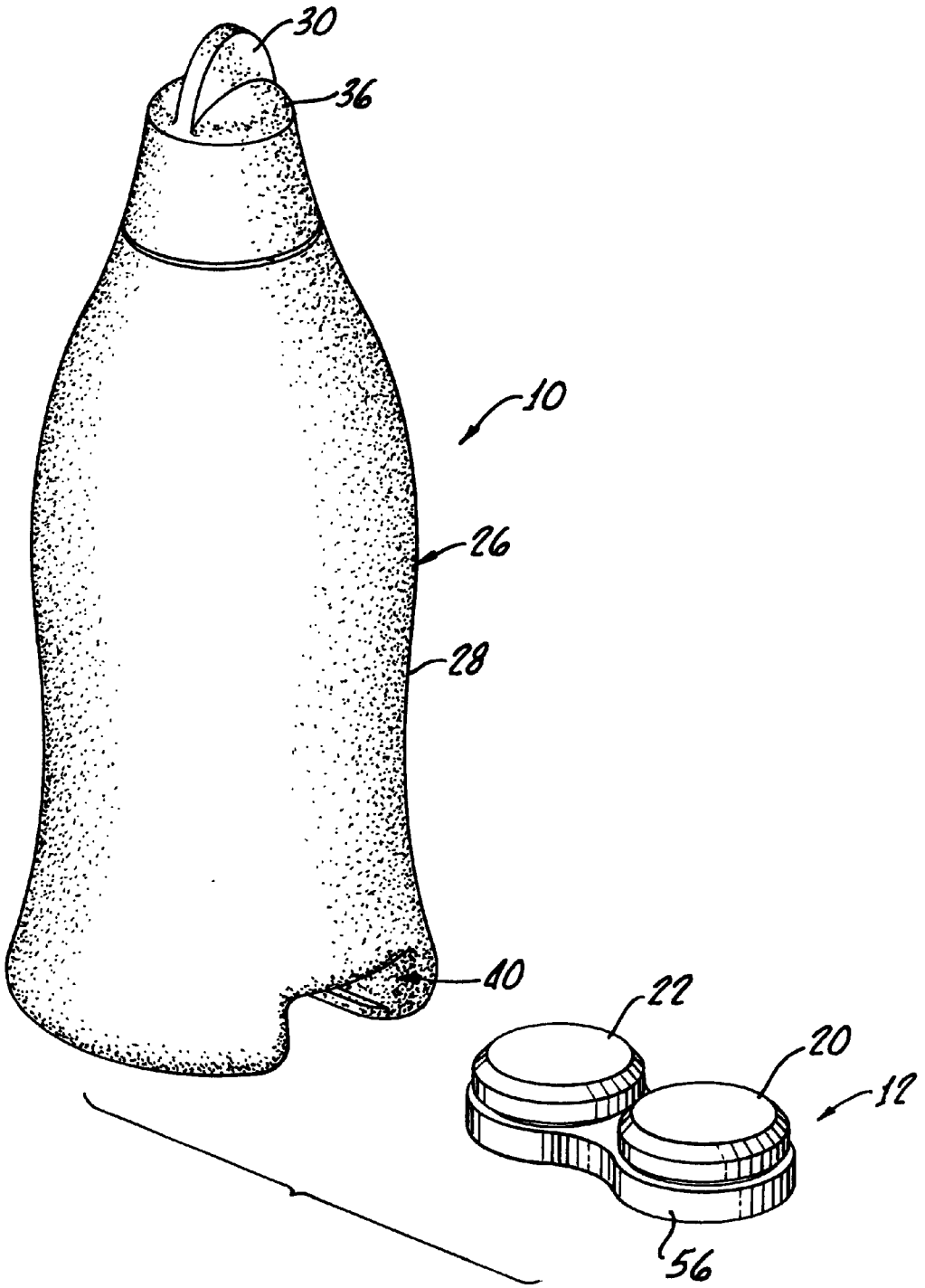
FIG. 5, is a perspective view of the container arrangement in accordance with the present invention showing the insertion of the lens case into a bottle cavity.

Also importantly, the lens case base 56 is formed in an arcuate shape, as most clearly shown in FIG. 3, and 5 formed from a material, such as a suitable plastic, for providing flexure of the base 56, in order to provide means for inhibiting transverse sliding of the case 12 within the slot 50 without external force being applied thereto. That is, the base may have a width slightly greater than the slot 50 width, but slight flexure of the lens base as is inserted into the slot 50, provides for a spring-like or frictional engagement to prevent inadvertent sliding of the lens case 12 from the slot 50.

While the lens case 12 may be removed from the bottle from one side 66 or another side 68 (see FIG. 3) in order to provide easy access to the contact lens case 12, positive pressure must be applied to the lens case 12 in a transverse direction in order to remove the case 12 from the bottle bottom 42. Thus, accidental, or inadvertent separation of the lens case 12 and the bottle 26 is prevented, or inhibited, by the arcuate shape of the base 56, and the slot 50 width.

Another important feature of the present invention is most clearly shown in FIG. 2. Because the lens case 12 and caps 20, 22 are stored in an upright level orientation, solution contained in the lens case receptacles 14, 16 does not contact a cap receptacle interface (not shown), thus preventing leakage of contact solution if the cap 20, 22 is not securely fitted to the receptacle 14, 16. In addition, because the contact lens case 12 is held within the confines of the bottle bottom perimeter 42, inadvertent loosening of the caps 20, 22 is also prevented. Because the bottle is stable when resting on its bottom and its normal storage position is in an upright position, secure storage of the contact lenses (not shown) within the lens case is assured by the container arrangement in accordance with the present invention.

Further, a height of the slot 50, measured between the lips 60, 62 and a top 70 of the slot 50, prevents insertion of the contact lens case if the caps 20, 22 are not fully screwed to the receptacles 14, 16. This provides further security for the storage of contact lenses with maintained submersion in contact lens solution.

Although there has been hereinabove described a specific container arrangement for illustrating the manner in which the invention may be used to advantage, it should be appreciated that the invention is not limited thereto. Accordingly, any and all modifications, variations, or equivalent arrangements which may occur to those skilled in the art, should be considered to be within the scope and spirit of the present invention as defined in the appended claims.

What is claimed is:

1. A container arrangement for contact lenses and solution therefor, the arrangement comprising:

a contact lens case including a molded base, having right and left receptacle means, disposed in a side-by-side relationship, for receiving a pair of contact lenses and contact lens solution, and cap means for sealing the receptacle means;

bottle means for containing a contact lens solution;

cavity means, comprising a slot extending transverse to a bottle means longitudinal axis and integrally formed into a bottom of the bottle, for receiving and holding said contact lens case within confines of a bottle bottom perimeter and in an orientation providing upright level storage of the contact lens; and means for inhibiting transverse movement of the contact lens case within the slot without external force being applied thereto, the means for inhibiting transverse movement comprising, in combination, means for defining an elongate, arcuate shape of the molded base and a molded base material providing flexure thereof.

2. The container arrangement according to claim 1 wherein said slot comprises lip means, disposed flush with a bottom surface of said bottle means, for preventing downward separation of said contact lens case and said bottle means.

3. The container arrangement according to claim 1 wherein the slot is disposed along a diameter of the bottle bottom.

4. The container arrangement according to claim 3 wherein said slot extends across the bottle bottom from one side of said bottle means to another side of said bottle means in order to provide access to the contact lens case from the one and the another sides of said bottle means.

5. The container arrangement according to claim 4 wherein the bottom of the bottle means has a closed surface area greater than an open surface area defined by the slot.

6. A container arrangement for contact lenses and solution therefor, the arrangement comprising:

a contact lens case including a molded base, having right and left receptacle means, disposed in a side-by-side relationship, for receiving a pair of contact lenses and contact lens solution, and cap means for sealing the receptacle means;

bottle means for containing a contact lens solution;

cavity means, comprising a slot extending transverse to a bottle means longitudinal axis and integrally formed into a bottom of the bottle, for receiving and holding said contact lens case within confines of a bottle bottom perimeter to prevent inadvertent loosening of said cap means; and means for inhibiting transverse movement of the contact lens case within the slot without external force being applied thereto, the means for inhibiting transverse movement comprising, in combination, means for defining an elongate, arcuate shape of the molded base and a molded base material providing flexure thereof.

7. The container arrangement according to claim 6 wherein said slot comprises lip means, disposed flush with a bottom surface of said bottle means, for preventing downward separation of said contact lens case and said bottle means.

8. The container arrangement according to claim 6 wherein the slot is disposed along a diameter of the bottle bottom.

9. The container arrangement according to claim 8 wherein said slot extends across the bottle bottom from one side of said bottle means to another side of said bottle means in order to provide access to the contact lens case from the one and the another side of said bottle means.

10. The container arrangement according to claim 9 wherein the bottom of the bottle means has a closed surface area greater than an open surface area defined by the slot.

11. A container arrangement for contact lenses and solution therefor, the arrangement comprising:

a contact lens case having right and left receptacle means for receiving a pair of contact lenses and contact lens solution and cap means for sealing the receptacle means;

bottle means for containing a contact lens solution; and cavity means, integrally formed into a bottom of the bottle, for receiving and holding said contact lens case within confines of a bottle bottom perimeter, said cavity means including means for preventing insertion of the contact lens case therein if the cap means is not fully sealed to the receptacle means.

12. The container arrangement according to claim 11 wherein the cavity means further comprises a lip, and said means for preventing insertion is defined by a height of the cavity means, the height being defined between a top surface of the cavity means and an upper surface of the lip.

13. The container arrangement according to claim 12 wherein said contact lens case comprises an elongate, molded base having the right and left receptacle means disposed in a side by side relationship and wherein the cavity means comprises a slot extending transverse to a bottle means longitudinal axis.

14. The container arrangement according to claim 13 wherein the molded base includes means for inhibiting transverse movement of the contact lens case within the slot without external force being applied thereto, said means for inhibiting transverse movement comprising, in combination, means for defining an arcuate shape of the molded base and a molded base material providing flexure thereof.

* * * * *